US005083645A

United States Patent [19]

Lee

[11] Patent Number: 5,083,645

[45] Date of Patent: Jan. 28, 1992

[54] LUGGAGE CASE

[75] Inventor: Doo Y. Lee, Seoul, D.P.R. of Korea

[73] Assignee: Skyway Luggage Company, Seattle, Wash.

[21] Appl. No.: 583,286

[22] Filed: Sep. 17, 1990

[51] Int. Cl.[5] ..... A45C 5/14; A45C 13/04; A45C 13/36

[52] U.S. Cl. ..... 190/113; 190/18 A; 190/122; 190/126; 190/127

[58] Field of Search ..... 190/18 A, 37, 113, 122, 190/124, 126, 127, 107, 24, 123

[56] References Cited

U.S. PATENT DOCUMENTS

| | | | |
|---|---|---|---|
| 1,999,424 | 4/1935 | Seitz | 190/127 X |
| 2,016,520 | 10/1935 | Short | 190/122 X |
| 2,269,574 | 1/1942 | Benenfeld | 190/126 |
| 2,710,084 | 6/1955 | Braverman | 190/107 |
| 2,718,943 | 9/1955 | Braverman | 190/107 |
| 2,806,563 | 9/1957 | Einhorn | 190/107 |
| 3,298,480 | 1/1967 | Kish, Jr. . | |
| 3,305,052 | 2/1967 | Kish, Jr. . | |
| 3,411,610 | 11/1968 | Bialo . | |
| 3,477,553 | 11/1969 | Kish, Jr. . | |
| 3,497,041 | 2/1970 | Samhammer | 190/18 R |
| 3,592,314 | 7/1971 | Jacobson . | |
| 3,613,843 | 10/1971 | Davis | 190/126 X |
| 3,730,308 | 5/1973 | Pelavin | 190/124 X |
| 3,977,501 | 8/1976 | Alonso . | |
| 4,176,734 | 12/1979 | Wang | 190/122 |
| 4,262,780 | 4/1981 | Samuelian | 190/18 A |
| 4,610,334 | 9/1986 | Pelavin | 190/122 |

FOREIGN PATENT DOCUMENTS

| | | | |
|---|---|---|---|
| 519374 | 4/1955 | Belgium | 190/113 |
| 544391 | 9/1959 | Belgium | 190/113 |
| 1949312 | 4/1971 | Fed. Rep. of Germany | 190/122 |
| 124858 | 5/1949 | Sweden | 190/37 |
| 287423 | 4/1953 | Switzerland | 190/122 |
| 372074 | 5/1932 | United Kingdom | 190/127 |

*Primary Examiner*—Sue A. Weaver
*Attorney, Agent, or Firm*—Seed and Berry

[57] ABSTRACT

A luggage case including a rectangular shell of relatively flexible material having a back, front, top, bottom and ends, with the front having a closable opening therein; a reinforcing strip which extends along the top and partially down each of the side for providing structural support to the shell to maintain the rectangular shape thereof; and a pair of support rods respectively secured to the sides, each of the support rods having a substantially rectangular shape corresponding to the shape of the perimeter of each of the sides, and being secured thereto. In this manner, when a force is exerted on the sides, the sides may flex in the direction of the force, and when the force is removed, the sides will resume their initial position due to the elastic restoring force of the support rods. Both the reinforcing strip and the support rods are disposed on the inside surfaces of the luggage case. The luggage case further may include a plurality of wheel units which are disposed on the underside of the bottom at a location proximate the sides, each wheel unit having a U-shaped tongue which extends therefrom and which entraps each of the support rods so as to maintain the position of the support rods.

10 Claims, 2 Drawing Sheets

LUGGAGE CASE

DESCRIPTION

1. Technical Field

The present invention relates to a luggage case having a flexible, reinforced frame which resiliently maintains its shape.

2. Background of the Invention

Soft-sided luggage cases are known in the art. Generally, this type of case includes a wide reinforcing member which circumscribes the entire interior perimeter of the luggage case extending along the top, side and bottom portions of the case, or top and bottom reinforcing members with separate rigid or semirigid, planar end supports. The purpose of the reinforcing members are to maintain the structural integrity of the case. In order to minimize the weight of the luggage case, efforts have been made to reduce the width and thickness of the reinforcing members and/or the planar end supports. However, by reducing the size of the reinforcing members and the end supports, the strength of the reinforcing members and end supports has correspondingly been reduced. Accordingly, the interior structure of many of the luggage cases available today is not sufficiently strong to prevent damage to the cases when an impact force is exerted on the end of the cases, for instance. Specifically, because of the reduced thickness and width, the reinforcing members and end supports are often permanently deformed or broken due to impact forces exerted thereon. As the reinforcing members and end supports in known luggage cases also serve as the primary structural support for the end of the cases, when bent or broken, the cases lose their normal rectangular shape.

SUMMARY OF THE INVENTION

The present invention resides in a luggage case which is designed to eliminate this problem by providing strength at minimum weight. In particular, the luggage case includes a fabric shell of relatively flexible material having a back, front, top, bottom and ends, with the front having a closable opening therein; a reinforcing member which extends along the top and partially down each of the ends and which is attached to the shell at each end for providing structural support to the shell to maintain the shape thereof; and a pair of support rods respectively secured to the ends, each of the support rods having a shape corresponding to the shape of the perimeter of each of the ends. This unique design is advantageous in that it is not necessary to secure the reinforcing member to each of the support rods resulting in a substantial cost savings.

In the preferred embodiment of the invention, the support rods are elastically flexible such that when a force is exerted on the ends, the ends will flex in the direction of the force, and when the force is removed, the ends will resume their initial position due to the elastic restoring force of the support rods. Both the reinforcing member and the support rods are disposed on the inside surfaces of the luggage case. Since the reinforcing member does not extend along the full length of each of the ends, substantial impact forces can occur against the ends without damage to the case. The fabric shell can yield, the flexible support rods can yield, and there is no solid surface that can be broken or bent.

In one embodiment, the luggage case further includes a plurality of wheel units which are disposed on the underside of the bottom at a location proximate the sides, each wheel unit having a U-shaped tongue which extends therefrom and which entraps each of the support rods so as to maintain the position of the support rods.

DETAILED DESCRIPTION OF THE INVENTION

Figure 1:
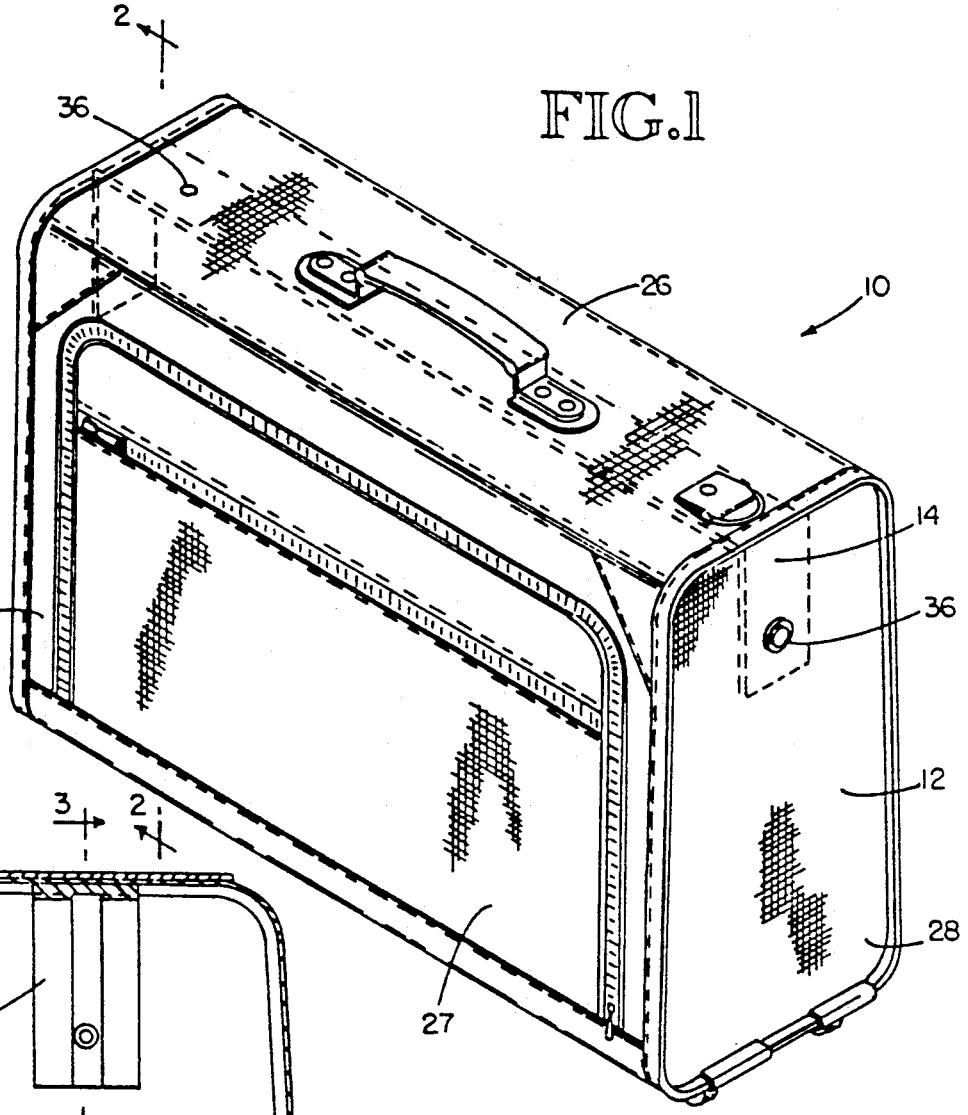
FIG. 1 is a perspective view of the luggage case in accordance with the present invention.
Figure 2:
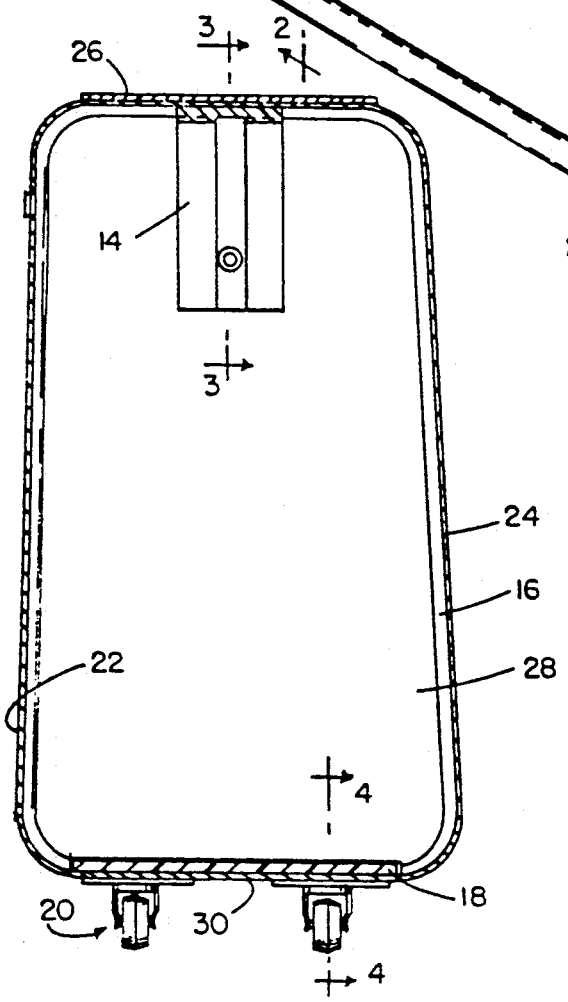
FIG. 2 is a sectional view taken along line 2—2 of FIG. 1.

Referring to FIGS. 1 and 2, the luggage case 10 includes a shell 12, a reinforcing member 14, a pair of encircling, strong, support rods 16, a conventional, stiff, planar bottom support 18 and a plurality of wheel units 20. The support rods are of a substantial thickness, being preferably about 3/16 inch in diameter. The shell includes a front 22, back 24, top 26, ends 28, and bottom 30 to form a substantially rectangular luggage case. The shell is made of a relatively soft material, such as, for instance, nylon, polyester, leather, or any other appropriate soft flexible fabric. The front 22 of the shell includes a zippered opening 27 secured thereto for allowing access to the interior of the case.

The rectangular shape of the shell is maintained by a combination of the reinforcing member 14, the support rods 16 and the bottom support 18 disposed on the bottom 30 of the case. As illustrated, the reinforcing member 14 extends along the entire length of the top 26 and continues partially down the opposing ends 28. The reinforcing member 14 is secured to the shell by utilizing fasteners, such as rivets 36, as shown, and is made out of an elongate strip of a rigid material, such as rigid plastic or steel. The width and thickness of the reinforcing member 14 are dimensioned to insure that the reinforcing member is rigid enough to locate and maintain the spacing of the end panels 28 and thus the rectangular shape of the shell 12.

Figure 3:
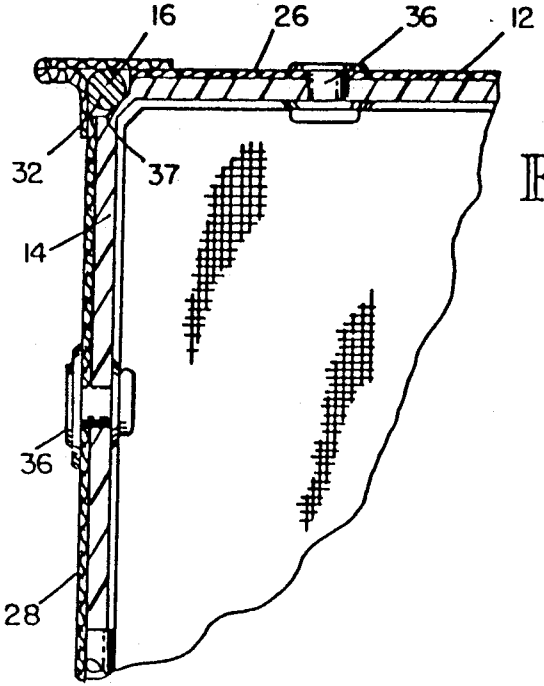
FIG. 3 is a partial sectional view taken along line 3—3 of FIG. 2.

As illustrated in FIGS. 1 through 3, the reinforcing member 14 is not continuous around the case but extends only approximately one quarter of the way down the ends 28. Thus, as compared to the conventional luggage case, the luggage case according to the present invention is much lighter in weight, since the reinforcing member does not circumscribe the entire perimeter of the case. Moreover, if an impact force is exerted at the midportion of the ends 28, the force will not be exerted directly against the reinforcing member, and therefore will not result in bending or damage to the reinforcing member. It has been discovered that the resulting luggage case maintains its shape as well as the conventional design, and yet is more resilient than the conventional case.

Referring to FIGS. 2 and 3, each of the support rods 16 is substantially circular in cross section and rectangular in shape, as illustrated. The support rods 16 are preferably made out of an elastically flexible but strong material such as spring steel or an equivalent plastic material. However, it is not necessary that the support rods be flexible. Accordingly, the support rods could be made out of a strong steel with limited flexibility. The support rods are adhered to the outer perimeter of the ends 28 where the ends are joined to the top 26, front 22, back 24 and bottom 30. Since, as noted above, the reinforcing member 14 is secured at opposite ends thereof to each end 28 utilizing fasteners 36, as illustrated in FIG. 3, the support rods, in combination with the reinforcing member, provide the necessary structural support for the shell to maintain the case-like shape without the reinforcing member being secured directly to the support rods, resulting in a cost savings.

Figure 4:
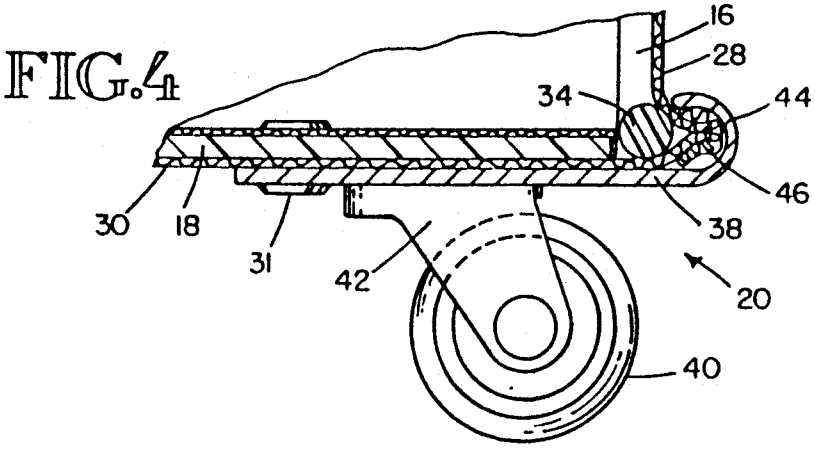
FIG. 4 is a partial sectional view taken along line 4—4 of FIG. 2.

However, the top portion 32 and bottom portion 34 of the support rods 16 may be secured to the case in the manner illustrated in FIGS. 3 and 4, respectively. Specifically, as can be seen in FIG. 3, the reinforcing member 14 has a notched portion 37 at each bend Where the reinforcing member 14 is bent 90° to extend down the ends. The notched portions 37 are dimensioned to receive the top portion 32 of each of the support rods, as illustrated. In this manner, when a force is applied to the bag, the top portion 32 of each of the support rods 16 is retained by the reinforcing member. Referring to FIG. 4, the bottom portion 34 of each of the support rods is disposed between the bottom support 18 and the wheel units 20, in the manner described below. However, it should be understood that the invention is not limited to this specific arrangement.

As illustrated in FIG. 4, four wheel units 20 are disposed on the underside of the bottom support 18 utilizing fasteners 31 which extend through the bottom support. Each of the wheel units includes an upper plate 38 to which a wheel 40 is secured via bracket 42. The upper plate has a substantially U-shaped portion 44 which overlaps welting 46 where the ends 28 are secured to the bottom 30. The U-shaped portion of each of the plates is dimensioned so as to retain each of the bottom portions 34 of each of the support rods 16 between the end of the U-shaped portion 44 and the bottom support 18, as illustrated. Thus the wheel brackets support and locate the bottom of the support rod.

Referring again to FIG. 4, the welting 46 joining the bottom 30 and the ends 28 is disposed external to the support rods 16. Although not specifically illustrated, the welting which joins the ends 28 to the front 22, top 26, and back 24 is also disposed external to the support rod.

As can be seen from the foregoing, the resulting luggage case is lighter in weight than the conventional luggage case described above, and yet provides the necessary structural support and structural flexibility to maintain the shape of the case in the course of normal handling. Additionally, since the reinforcing member does not extend around the entire circumference of the luggage case, the reinforcing members will not be deformed or damaged when impact forces are applied to the ends of the case.

I claim:

1. A luggage case, comprising:

a shell of relatively flexible material having a back, front, top, bottom and ends, said front having a closable opening therein;

a reinforcing member extending along said top and only partially down each of said ends of said shell, means for attaching said member to the shell, said reinforcing member providing structural support to said shell and locating the ends thereof so as to maintain the length of the case; and a pair of support rods respectively secured to said ends, each of said support rods having a shape corresponding to the shape of the perimeter of each of said ends, means securing said rods to only said shell at the perimeter of each of said ends such that when the case is in the upright position, said reinforcing member and said support rods are positioned proximate one another but are not directly secured to one another whereby said reinforcing member maintains the length of the case and said support rods maintain the shape of the perimeter of the case so that said reinforcing member and said support rods combine to provide the necessary structural support to maintain the shape of the case.

2. The luggage case of claim 1 wherein said case has a substantially rectangular shape.

3. The luggage case of claim 1 wherein said reinforcing member is disposed on the inside surface of said top.

4. The luggage case of claim 1 wherein said support rods are elastically flexible such that when a force is exerted on said ends, either at the shell or against the support rods, said ends may flex in the direction of said force, and when said force is removed, said ends will resume their initial position due to the elastic restoring force of said support rods.

5. The luggage case of claim 1 wherein said support rods are respectively disposed on the inside surfaces of said ends, and wherein a welting respectively adjoining the ends to the back, front, top and bottom of said shell is located externally of the support rods.

6. The luggage case of claim 5 wherein each of said support rods includes a portion that is disposed between the interior of said shell and said reinforcing member.

7. The luggage case of claim 6 wherein said reinforcing member includes means for locating the position of each of said support rods adjacent corners respectively defined by said top and each of said ends.

8. The luggage case of claim 1, further comprising a plurality of wheel units disposed on the underside of said bottom proximate said sides, each of said wheel units having means for simultaneously securing said wheel units to said shell and for retaining each of said support rods in respective corners defined by said bottom and said ends such that said support rods cannot move downwardly past said bottom.

9. The luggage case of claim 8 wherein said securing means comprises a U-shaped tongue extending from each of said wheel units and entrapping each of said support rods.

10. The luggage case of claim 8 wherein said support rods are made of one or spring steel and equivalent plastic.

* * * * *